US008112851B1

(12) United States Patent
Hughes

(10) Patent No.: US 8,112,851 B1
(45) Date of Patent: Feb. 14, 2012

(54) CASKET WITH RETRACTABLE HANDLE

(76) Inventor: Paul D. Hughes, Midland, TX (US)

( * ) Notice: Subject to any disclaimer, the term of this patent is extended or adjusted under 35 U.S.C. 154(b) by 0 days.

(21) Appl. No.: 12/897,009

(22) Filed: Oct. 4, 2010

(51) Int. Cl.
*A61G 17/00* (2006.01)

(52) U.S. Cl. ..... 27/27; 16/429

(58) Field of Classification Search ..... 27/27, 2; 16/424, 439, 425, 429, 110.1, 113.1, DIG. 24; 220/759
See application file for complete search history.

(56) References Cited

U.S. PATENT DOCUMENTS

| | | | | |
|---|---|---|---|---|
| 582,239 | A | 5/1897 | Snypp | |
| 686,280 | A | 11/1901 | Gaudin | |
| 751,685 | A | 2/1904 | Sanford | |
| 869,423 | A | 10/1907 | Cowan | |
| 959,235 | A | 5/1910 | Lemieux | |
| 1,016,392 | A | 2/1912 | Boudrot | |
| 1,112,517 | A | 10/1914 | Boisvert | |
| 1,851,225 | A | 3/1932 | Wesemann | |
| 2,091,495 | A | 8/1937 | Steen | |
| 2,527,721 | A * | 10/1950 | Haacke | 16/429 |
| 3,243,837 | A | 4/1966 | Smith | |
| 3,744,084 | A | 7/1973 | Fankhouser | |
| 3,844,003 | A | 10/1974 | Angermann | |
| 4,146,948 | A * | 4/1979 | Royce et al. | 27/2 |
| 5,372,363 | A | 12/1994 | Siddle | |
| 7,921,528 | B2 * | 4/2011 | Elhaj | 27/12 |

FOREIGN PATENT DOCUMENTS

JP 08238278 A * 9/1996

* cited by examiner

*Primary Examiner* — William L. Miller
(74) *Attorney, Agent, or Firm* — Gable Gotwals

(57) ABSTRACT

A casket with retractable handles which are flush with the sidewalls. The casket comprises a first and second sidewall, a first and second end wall, an exterior bottom, an interior floor, a top connected to one of said sidewall and at least one reinforcement member offset form one of said sidewall. A first and second opening are linearly aligned and pass through a sidewall and the reinforcement member respectively. An elongated handle with a first end and a second end, extends through and is slidingly received in said first and second opening, said handle having a stored position wherein said first end is flush with said sidewall and an extended position where said handle extends from said sidewall. In the preferred embodiment the elongated handles are located between a plane of the exterior bottom and a plane of the interior floor.

10 Claims, 3 Drawing Sheets

CASKET WITH RETRACTABLE HANDLE

1. FIELD OF THE INVENTION

The present invention relates generally to burial caskets. More particularly, the present invention relates to a burial handle with retractable handles.

2. BACKGROUND OF THE INVENTION

Burial or internment in a casket is the most common method in the United States and many other countries to dispose of human remains. The body of the deceased is placed in the casket which is then placed in a burial vault and buried. Similarly the casket can be placed in a mausoleum or crypt.

Caskets come in a standard size, typically having external dimensions of 20"×30"×79" (H×W×L). In order to avoid the additional cost for non standard or oversized vaults or crypts, the exterior dimensions of the casket must fit within a standard sized vault or crypt.

The obesity epidemic facing the United States and other developed nations has presented a new problem to the bereaved and funeral industry as a whole. When an obese individual dies, they often will not fit inside a standard sized casket. This means an oversized casket must be used. If the exterior dimensions of the oversized casket (including the side handles) exceeds the interior dimensions of the burial vault, an oversized burial vault must be used. All of this adds a considerable amount of additional expense.

In placing an obese person into a casket and then into a burial vault the critical dimension becomes the width of the casket. This situation is complicated by the fact the exterior width of the casket is increased by the handles located on either side of the exterior of the casket. If the exterior width of the casket is 30" this will typically leave the prior art casket with an interior width of 22" to 24".

What is needed is a way to more efficiently use this external width of the casket. Essentially this means finding away to maximize the internal width of the casket while maintaining the overall external width of the casket within the standard internal width of a standard sized burial vault.

Prior art teaches various caskets handles which extend and retract. However none of these provide a handle which is flush with the exterior wall of the casket while the handle is in a stored or retracted position.

Further the handles in prior that do retract partially into the sidewall of the casket require an increased thickness of the sidewall. This means that while the amount the retracted handle protrudes from the exterior of the sidewall is reduced the interior width is diminished. Thus they do not provide a solution to this problem.

What is needed, therefore, is a casket which has handles that maximize the interior width while minimizing the exterior width.

BRIEF SUMMARY OF THE INVENTION

The present invention achieves its objections by providing a casket with retractable handles which are flush with the sidewalls. The casket comprises a first and second sidewall, a first and second end wall, an exterior bottom, an interior floor, a top connected to one of said sidewall and a reinforcement member offset form one of said sidewall. A first and second opening are linearly aligned and pass through a sidewall and the reinforcement member respectively. An elongated handle with a first end and a second end, extends through and is slidingly received in said first and second opening, said handle having a stored position wherein said first end is flush with said sidewall and an extended position where said handle extends from said sidewall. In the preferred embodiment the first and second opening, and elongated handle are received in between the bottom of the casket and interior floor of the casket.

The present invention allows the casket manufacturer to maximize the interior width of the casket while maintaining an outside width capable of fitting into a standard sized burial vault.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
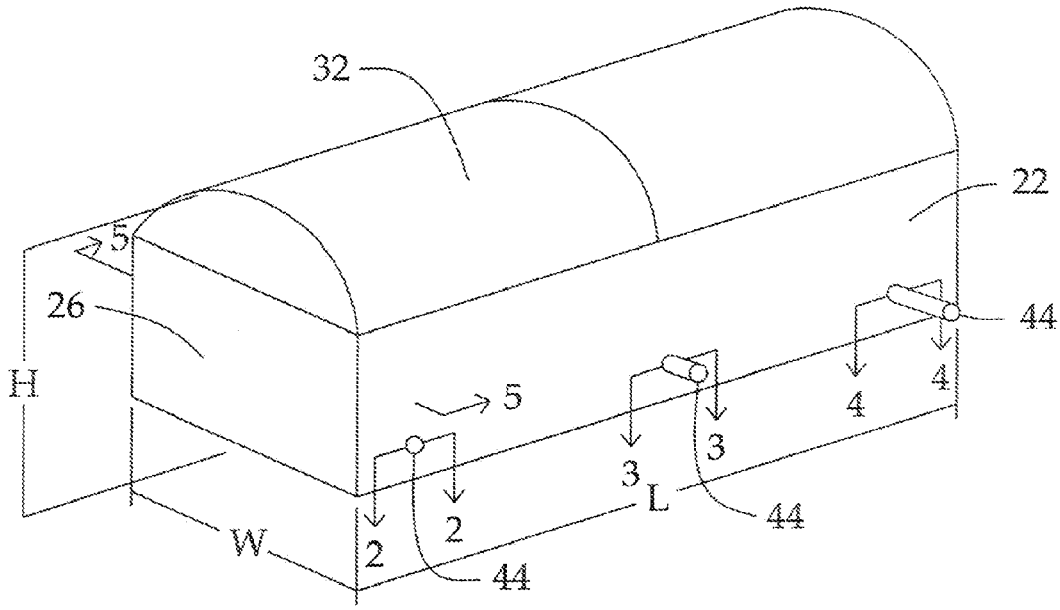
FIG. 1 is a perspective view of one embodiment of the present invention.
Figure 5:
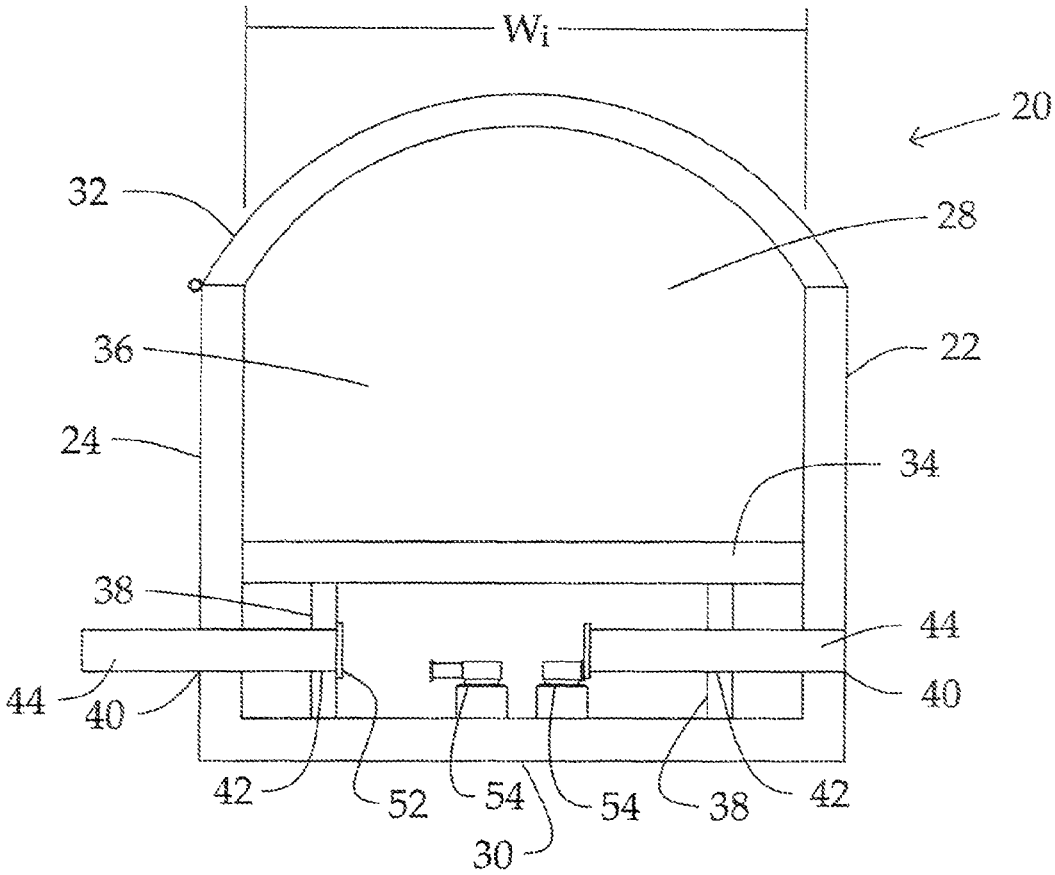
FIG. 5 is a sectional view of one embodiment of the present invention showing the preferred location of the first and second opening and reinforcement member located between the bottom of the casket and the interior floor of the casket and showing one handle in a stored position and one handle in a extended position.

Turning now to the drawings wherein like reference characters indicate like or similar parts throughout, FIG. 1 is a perspective view of a casket 20 according to one embodiment of the present invention. The exterior dimensions of the casket are indicated by H, W and L. The casket 20 has a first and second sidewall 22 and 24, a first and second end wall 26 and 28, an exterior bottom 30 and a top 32 connected to one of the sidewalls 22 or 24. As best seen in FIG. 5, the preferred embodiment of the casket 20 also has the interior floor 34 located between the exterior bottom 30 and the top 32. The sidewalls 22, 24, end walls 26, 28, top 32 and interior floor 34 define an interior volume 36 typically used to contain human remains.

As best seen in FIGS. 2 through 5, one or more reinforcement members 38 are located between the interior floor 34 and exterior bottom 30. They are also offset from one of the sidewalls 22 or 24. A first opening 40 passes through one of the sidewalls 22 or 24. A second opening 42 passes through the reinforced member and is aligned with the first opening 40.

Figure 2:
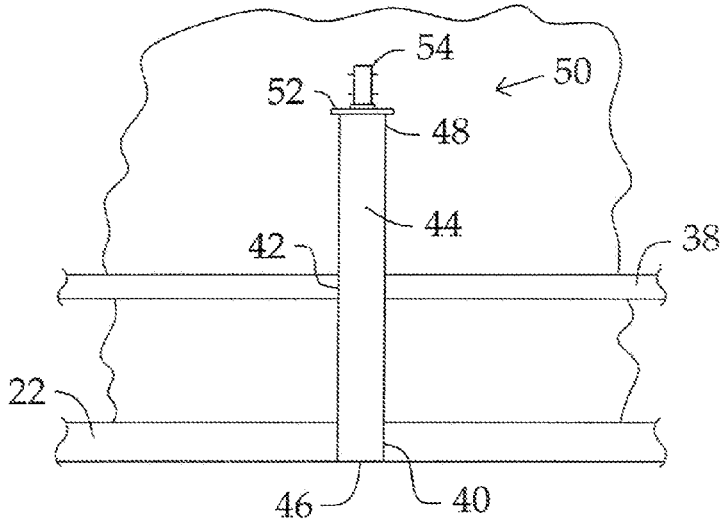
FIG. 2 is a sectional view of one embodiment of the present invention with the handle in the stored position.
Figure 4:
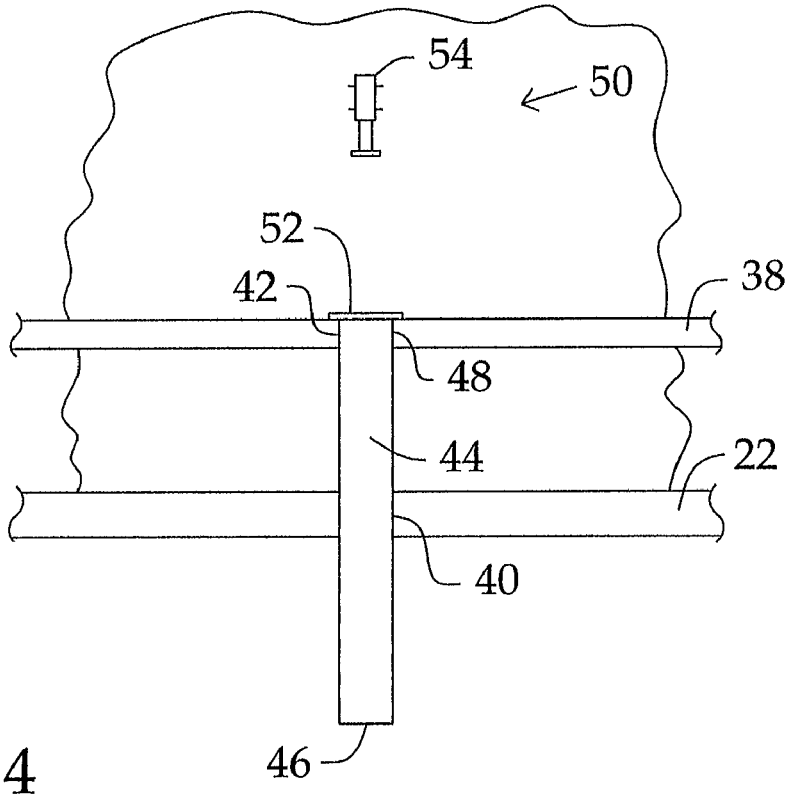
FIG. 4 is a sectional view of one embodiment of the present invention with the handle in the extended position.

An elongated handle 44 with a first end 46 and a second end 48 extends through and is slidingly received in the first and second opening 40 and 42. The handle 44 has a stored position as seen in FIG. 2 wherein the first end 46 of the elongated handle 44 is flush with the sidewall 22 or 24. The handle 44 also has an extended position where the handle extends from the sidewall 22 or 24 as seen in FIG. 4.

Figure 3:
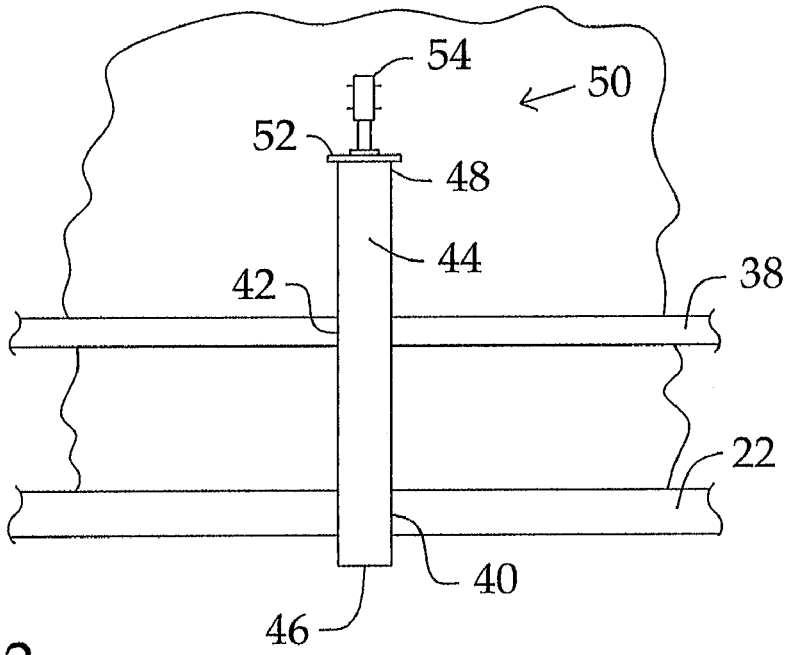
FIG. 3 is a sectional view of one embodiment of the present invention with the handle in the partially extended position.

FIG. 2 shows the elongated handle 44 in the stored position such that the first end 46 of elongated handle 44 is flush with the sidewall 22 or 24. FIG. 3 shows the elongated handle 44 in the partially extended position such that the first end 46 of the elongated handle 44 protrudes out from the sidewall 22 or 24. Finally FIG. 4 shows the elongated handle 44 in the extended position.

The preferred embodiment of the present invention has a retention mechanism 50. In the preferred embodiment the retention mechanism is comprised of a metal bracket or washer 52 located on the second end 48 of the elongated handles 44. When the handle 44 is in the stored position the bracket 52 is engaged by a magnetic latch mechanism 54 which holds the elongated handle 44 securely in the stored position as best seen in FIG. 2.

In order to release the elongated handle 44 from the stored position, the first end 46 of the elongated handle 44 must be depressed inward towards the latch mechanism 54. This causes the latch mechanism 54 to extend as shown in FIG. 3. Thus placing the elongated handle 44 in the partially extended position. While in the partially extended position the elongated handle 44 protrudes from the sidewall 22 however it is held in place by magnetic attraction between the latch mechanism 54 and the bracket 52.

In order to move the elongated handle 44 into the extended position as seen in FIG. 4, the first end 46 of the elongated handle 44 must be pulled outward away from the latch mechanism 54. This overcomes the magnetic bond between the latch mechanism 54 and the bracket 52, thus allowing the elongated handle 44 to slide outwardly through the first and second openings 40 and 42 until the bracket 52 engages the reinforcement member 38 thus stopping the slide of the elongated handle 44 and thus retaining the handle 44 in the fully extended position. It is preferred the bracket 52 either be sized or located such that will not pass through the second opening 42 in the reinforcement member 38. This in turn retains the elongated handle 44 in the first and second openings 40 and 42.

In order to return the elongated handle 44 to the stored position, the elongated handle is slid inwardly until the second end 48 of the elongated handle 44 and the bracket 52 engage the latch mechanism 54. The elongated handle 44 is then pressed inwardly until the latch mechanism 54 is re-engaged with the elongated handle 44 in the stored position.

Turning now to FIG. 5 which shows a cross-sectional area of the preferred embodiment of the present invention. The elongated handle 44 on the right side of the Figure is in a stored position while the elongated handle 44 on the left side of the Figure is in the extended position. The interior width of the casket 20 is indicated by $W_i$. Here it is illustrated that the elongated handles 44 along with the first and second openings 40 and 42 and retention mechanism 50 are located in an area between the plane of the exterior bottom 30 and interior floor 34. By locating the handles in this area, the present invention avoids using valuable width of the casket to contain the elongated handles 44.

While the preferred embodiment of the present invention shown in the attached figures shows a magnetic type latch mechanism 54 which engages a magnetic bracket 52, other latch mechanisms 54 could be used to practice this invention.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A casket comprising:

a first and a second sidewall;

a first and a second end wall;

an external bottom;

a top connected to one of said sidewalls;

a reinforcement member offset from one of said sidewalls;

a first opening through one of said sidewalls;

a second opening through said reinforcement member and aligned with said first opening; and an elongated handle with a first end and a second end;

wherein said handle extends through and is slidingly received in said first and second opening, said handle sliding between stored position wherein said first end is flush with said sidewall and said second end is internal to said casket and an extended position where said handle extends from said sidewall such that said first end is external to said casket and said second end is internal to said casket.

2. The casket according to claim 1 further comprising a retention mechanism to retain said elongated handle in said stored position.

3. The casket according to claim 2, said retention mechanism comprising a spring loaded clasp.

4. The casket according to claim 3, said retention mechanism further comprising a magnet located on said spring loaded clasp located to engage a ferrous object secured to said second end of said elongated handle.

5. The casket according to claim 4, wherein said elongated handle is moved from said stored position to a partially extended position by pressing on the first end of said elongated handle while said elongated handle is in the stored position, wherein in said partially extended position said handle extends from said sidewall a smaller distance than when in said extended position.

6. The casket according to claim 5, wherein said elongated handle is moved from said partially extended position by pulling on said first end of said elongated handle while said elongated handle is in said partially extended position.

7. The casket according to claim 5, wherein said elongated handle is moved from said partially extended position to said stored position by pushing on said first end of said elongated handle while said elongated handle is in said partially extended position.

8. The casket according to claim 1, further comprising a stop to retain the elongated handle within the first and second opening.

9. The casket according to claim 1, further comprising an interior floor located between said exterior bottom and said top, wherein said second opening and said reinforcement member are located between said interior floor and said exterior bottom.

10. The casket according to claim 9, further comprising said elongated handle being located between a plane of said interior floor and a plane of said exterior bottom.

* * * * *